US008307640B1

(12) United States Patent
Callen

(10) Patent No.: US 8,307,640 B1
(45) Date of Patent: Nov. 13, 2012

(54) APPARATUS FOR GENERATING POWER

(76) Inventor: Dennis M. Callen, Fenton, MI (US)

( * ) Notice: Subject to any disclaimer, the term of this patent is extended or adjusted under 35 U.S.C. 154(b) by 0 days.

(21) Appl. No.: 13/253,369

(22) Filed: Oct. 5, 2011

(51) Int. Cl.
*F03B 7/00* (2006.01)
*F03B 17/04* (2006.01)

(52) U.S. Cl. ..... 60/398; 290/43

(58) Field of Classification Search ..... 60/398; 290/43, 54; 415/6, 916; 416/197 B
See application file for complete search history.

(56) References Cited

U.S. PATENT DOCUMENTS

| | | | | |
|---|---|---|---|---|
| 1,255,510 | A * | 2/1918 | Burgin | 415/186 |
| 4,201,059 | A * | 5/1980 | Feder | 60/639 |
| 4,443,707 | A * | 4/1984 | Scieri et al. | 290/4 R |
| 5,755,553 | A * | 5/1998 | Laemthongsawad | 415/3.1 |
| 6,073,445 | A * | 6/2000 | Johnson | 60/512 |
| 6,210,113 | B1 * | 4/2001 | Ihrenberger | 416/116 |
| 6,431,821 | B1 * | 8/2002 | Feltenberger et al. | 415/3.1 |
| 7,619,320 | B2 * | 11/2009 | Omer | 290/54 |
| 8,044,530 | B2 * | 10/2011 | Harris | 290/54 |
| 2008/0169654 | A1 * | 7/2008 | Omer | 290/4 R |
| 2011/0204627 | A1 * | 8/2011 | Ho et al. | 290/43 |

FOREIGN PATENT DOCUMENTS

| | | | |
|---|---|---|---|
| DE | 3938748 | A1 * | 6/1990 |
| DE | 196 13 599 | C2 | 11/1996 |
| WO | WO 2009/077662 | A9 | 6/2009 |

* cited by examiner

*Primary Examiner* — Thomas E Lazo
(74) *Attorney, Agent, or Firm* — The Weintraub Group, P.L.C.

(57) ABSTRACT

The present invention, called a sludge rotary motor, pertains to an apparatus for generating power which generally comprises a wheel assembly including a wheel, an axle, a ring gear, and a plurality of paddles extending outwardly from the wheel. A housing is provided to deliver a liquid-based material from a storage tank to the paddles, and the housing includes an arcuate portion and an inlet portion. The arcuate portion is positioned around an arcuate segment of the wheel and includes a substantially tubular curved inner surface, and the paddles pass through the arcuate portion. A liquid-based material is stored in an elevated storage tank to increase the weight of the liquid and delivered to the arcuate portion of the housing, thereby forcing the paddles downward and rotating the wheel assembly, which in turn can be used to drive a generator.

14 Claims, 7 Drawing Sheets

APPARATUS FOR GENERATING POWER

BACKGROUND OF THE INVENTION

1. Field of the Invention

The present invention pertains to an apparatus for generating power. More particularly, the present invention pertains to an apparatus for generating power by transferring potential energy into rotational kinetic energy. Even more particularly, the present invention pertains to an apparatus for generating power by using the weight of a heavy liquid flowing slowly from an elevated storage tank to rotate a wheel, which in turn, provides rotational kinetic energy used to generate electricity.

2. Description of the Prior Art

The use of water mills to generate rotational mechanical energy dates back to the ancient Romans and Greeks. For centuries thereafter, water mills were used to power various manufacturing processing applications, such as for flour, lumber, paper, cotton, textiles, and so forth. Traditional water mills have become obsolete for functional purposes in most places today. However, the basic physics concepts behind water mills are still used to generate electricity in modern hydropower plants.

There have been recent attempts to improve upon the water mill as a means for generating electricity. For instance, DE 19613599 to Fukai et al. discloses a device having an upper tank, a lower tank, a Pelton wheel, and a pump for pumping water from the lower tank to the upper tank. As water flows out the bottom of the upper tank it drives the Pelton wheel, which in turn, produces rotational kinetic energy used to generate electricity through appropriate means, such as a generator. The water then falls into the lower tank and is pumped back to the upper tank. A portion of the electricity generated by the Pelton wheel is diverted to help power the pump.

A similar device is disclosed in WO 2004/077662 to Tiltay. Tiltay discloses a device having an upper storage tank, a lower storage tank, a turbine which is driven by liquid flowing out the bottom of the upper storage tank, and a vaned wheel which is also driven by the liquid flowing out of the upper tank. Both the turbine and the vaned wheel are configured to produce electricity which can be used to help power a pump for pumping the liquid back from the lower tank to the upper tank.

Typical devices like those disclosed by Fukai et al. and Tiltay use liquids which are relatively thin and have the viscosity of water. It is believed that the liquids used with Fukai et al. and Tiltay are aqueous solutions—if not even just water. These devices rely upon the fast flow of the liquid to generate high rotational speeds and momentum in the wheel assembly. However, it is believed that these devices have shortcomings, at least in part, because they are not efficient enough at transferring the potential energy in the liquid into rotational kinetic energy.

The present invention, as detailed hereinbelow, seeks to resolve these issues by providing an apparatus for generating power by using the weight of the heavy liquid flowing slowly from an elevated storage tank to rotate a wheel, which in turn, provides rotational kinetic energy which can be used to generate electricity. The heavy oil-based liquid provides different characteristics which are believed to have advantageous characteristics over the prior art.

SUMMARY OF THE INVENTION

In a first embodiment hereof, the present invention provides an apparatus for generating power which generally comprises:

(a) a wheel assembly including a wheel, an axle, a ring gear, and a plurality of paddles extending outwardly from the wheel;

(b) a housing for delivering a liquid-based material from a storage tank to the paddles, the housing including an arcuate portion and an inlet portion, (i) the arcuate portion being positioned around an arcuate segment of the wheel, the arcuate portion having an open inlet, an open outlet, and a substantially tubular curved inner surface having a middle section which is dimensioned for close fitment about the paddles when the wheel assembly rotates and the plurality of paddles passes through the arcuate portion;

(ii) the inlet portion of the housing including a hollow conduit having an inlet end and an outlet end, the inlet end being secured to the storage tank and the outlet end being secured to the arcuate portion, such that the inlet portion delivers the liquid-based material from the storage tank to the arcuate portion of the housing;

(c) the storage tank having an interior chamber for housing the liquid-based material, and an outlet for exiting the liquid-based material from the storage tank, the outlet being secured to the inlet portion of the housing;

(d) a holding tank positioned below the wheel assembly and the housing for collecting the liquid-based material which has passed through the housing and exited the outlet of the arcuate portion;

(e) at least one pump assembly which includes a mechanical pump, means for driving the mechanical pump, and a conduit extending from the mechanical pump to a position outside of the holding tank;

(f) wherein the liquid-based material which is stored in the storage tank passes into the housing, applies a force against the plurality of paddles and rotates the wheel assembly, falls out through the bottom of the housing into the holding tank, and is then pumped out of the holding tank by the pump assembly.

Optionally, the conduit can extend from the mechanical pump to the storage tank so that the liquid-based material is re-circulated throughout the apparatus.

Optionally, each of the paddles has an outer edge and a seal disposed thereon for forming a barrier with the inner surface of the housing. The barrier does not allow the liquid-based material to pass between the seal and the inner surface of the housing.

Optionally, the storage tank can include heating elements for raising the temperature of the liquid-based material and means for mixing the liquid-based material to maintain a substantially homogenous consistency and temperature throughout the liquid-based material in the storage.

In a second aspect hereof, the present invention also is directed to an energy converter comprising:

(a) a storage tank for housing a liquid;

(b) a wheel assembly including an axle and a plurality of outwardly extending paddles;

(c) a housing including an inlet and an arcuate substantially tubular channel, the channel being positioned adjacent the wheel assembly, and configured to allow the paddles to pass therethrough as the wheel assembly rotates, the channel further having at least a portion which is dimensioned to form a seal with the paddles passing therethrough;

(d) wherein the liquid flows out of the storage tank, through the housing inlet, and through the tubular channel, whereby the axle of the wheel assembly is rotated by the flow of the liquid through the channel.

According to this embodiment, a holding tank can optionally be positioned below the wheel assembly and housing for collecting the liquid which has passed through the channel.

Optionally, the energy converter can also include at least one pump assembly which includes a mechanical pump, means for driving the mechanical pump, and a conduit extending from the mechanical pump to a position outside of the holding tank. More than one pump assembly can be provided as necessary to provide additional capacity and to divide the pumping of fluid between the provided pump assemblies.

Just as with the first embodiment, this embodiment can also optionally include wherein the conduit extends from the mechanical pump to the storage tank, wherein the storage tank includes means for mixing the liquid, and/or wherein the storage tank includes heating elements for raising the temperature of the liquid-based material.

In a third embodiment, the present invention comprises an energy converter comprising:

(a) a storage tank for housing a liquid;

(b) a wheel assembly including an axle, a ring gear, and a plurality of outwardly extending paddles;

(c) a conduit for delivering the liquid from the storage tank to at least one paddle in which the liquid applies a substantially downward force on the paddle causing the wheel assembly to rotate; and (d) at least one pump assembly which includes a mechanical pump and a drive gear for driving the mechanical pump.

Optionally, the conduit can form a sealed barrier with at least two of the rotating paddles.

Optionally, the energy converter according to this embodiment can also comprise a holding tank positioned below the wheel assembly and the conduit for collecting the liquid which has passed through the conduit.

Optionally, the pump assembly is configured to pump the liquid out of the holding tank.

For a more complete understanding of the present invention, reference is made to the following detailed description and accompanying drawings. In the drawings, like reference characters refer to like parts throughout the views in which:

DETAILED DESCRIPTION OF THE PREFERRED EMBODIMENT

Figure 1:
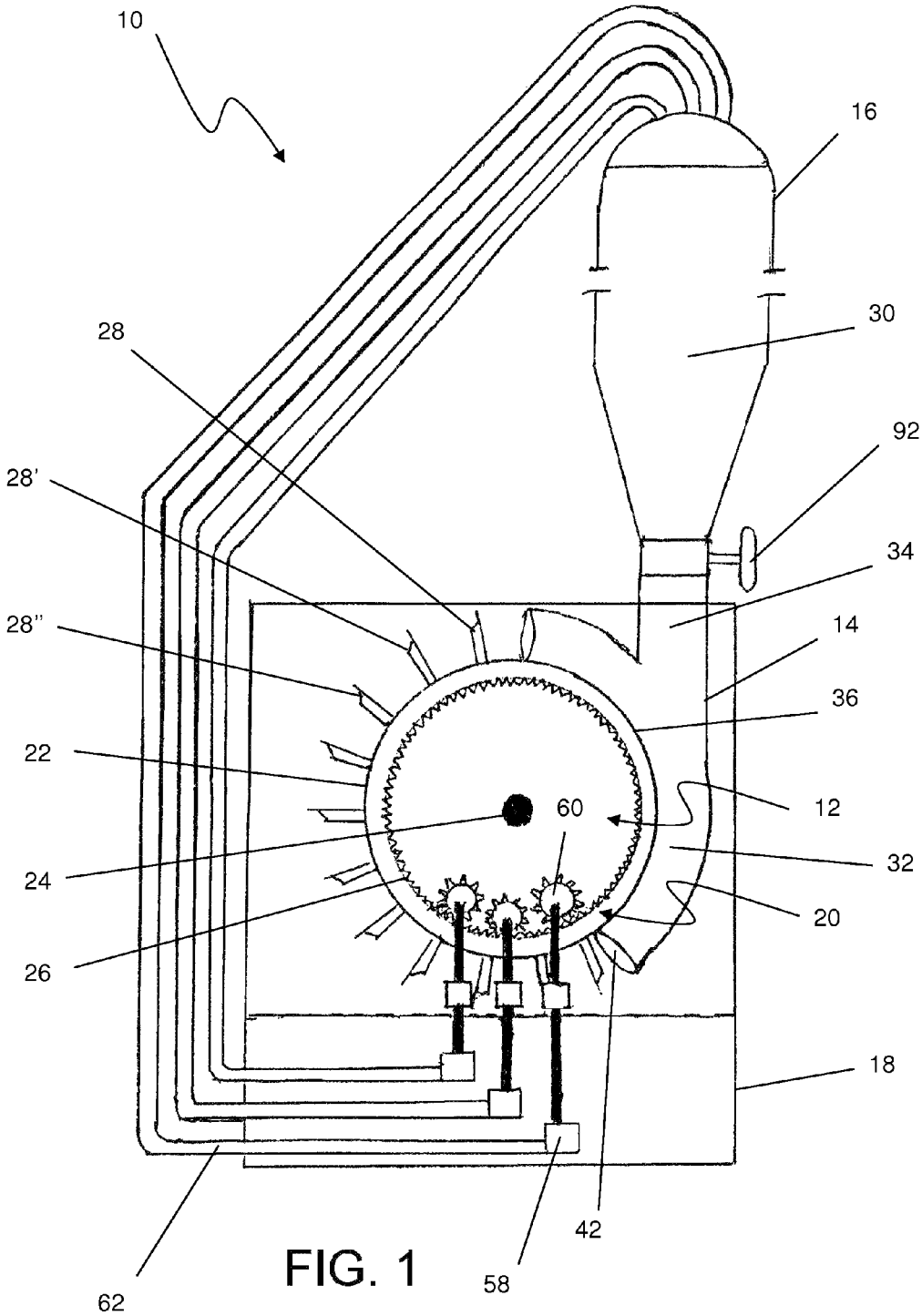
FIG. 1 is a front view showing the internal components of an embodiment of the present invention hereof.

In accordance with the present invention and as shown generally in FIG. 1, there is provided an apparatus 10 for generating power which generally comprises a wheel assembly 12, a housing 14, a storage tank 16, a holding tank 18, and at least one pump assembly 20. The wheel assembly 12 includes a wheel 22, an axle 24, a ring gear 26, and a plurality of paddles 28,28',28", etc. extending outwardly from the wheel 22.

The housing 14 is provided to deliver a liquid-based material 30 from the storage tank 16 to the paddles 28,28',28", etc., and the housing 14 includes an arcuate portion 32 and an inlet portion 34. The arcuate portion 32 is positioned around an arcuate segment 36 of the wheel 22 and has an open inlet 38, an open outlet 40, and a substantially tubular curved inner surface 42, or passageway. A middle section 44 is dimensioned for close fitment about the paddles 28,28',28", etc. when the wheel assembly 12 rotates and the plurality of paddles 28,28',28", etc. passes through the arcuate portion 32. The inlet portion 34 of the housing 14 includes a hollow conduit, or passageway 46, having an inlet end 50 and an outlet end 52. The inlet end 50 is secured to the storage tank 16 and the outlet end 52 is secured to the arcuate portion 32, such that the inlet portion 34 delivers the liquid-based material 30 from the storage tank 16 to the arcuate portion 32 of the housing 14.

The storage tank 16 has an interior chamber 54 and an outlet 56. The interior chamber 54 stores the liquid-based material 30, and the outlet 56 provides an exit for the liquid-based material 30 from the storage tank 16. The outlet 56 is secured to the inlet portion 34 of the housing 14.

The holding tank 18 is positioned below the wheel assembly 12 and the housing 14 for collecting the liquid-based material 30 which has passed through the housing 14 and exited the outlet 40 of the arcuate portion 32.

Each pump assembly 20 includes a mechanical pump 58, means 60 for driving the mechanical pump, and a conduit 62 extending from the mechanical pump 58 to a position outside of the holding tank 18.

Preferably, the liquid-based material 30 which is stored in the storage tank 16 passes into the housing 14, applies a force against the plurality of paddles 28,28',28", etc. and rotates the wheel assembly 12, falls out through the outlet 40 of the housing 14 into the holding tank 18, and is then pumped out of the holding tank 18 by the pump assembly 20.

Figure 3:
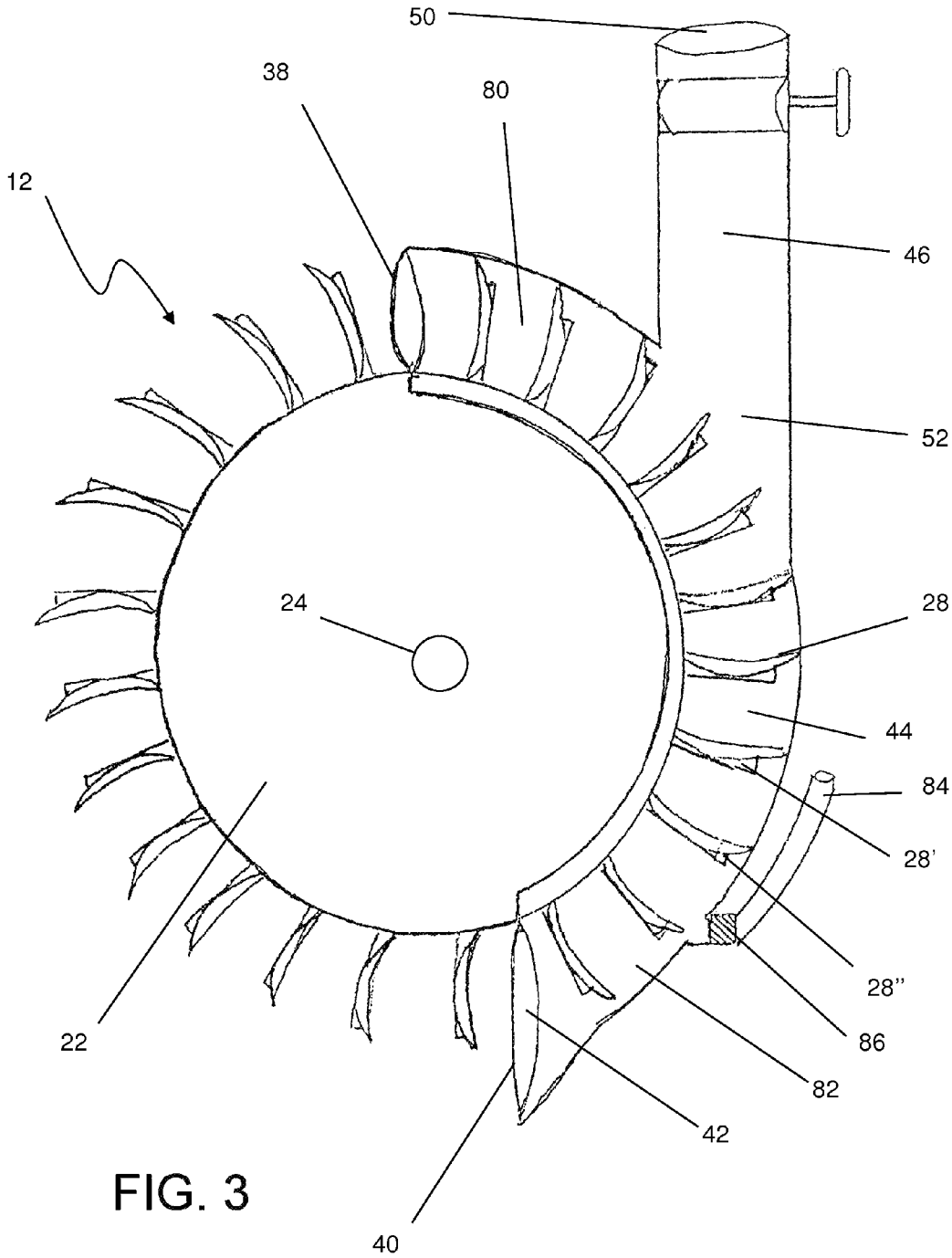
FIG. 3 is an enlarged view of the wheel assembly and housing.
Figure 4A:
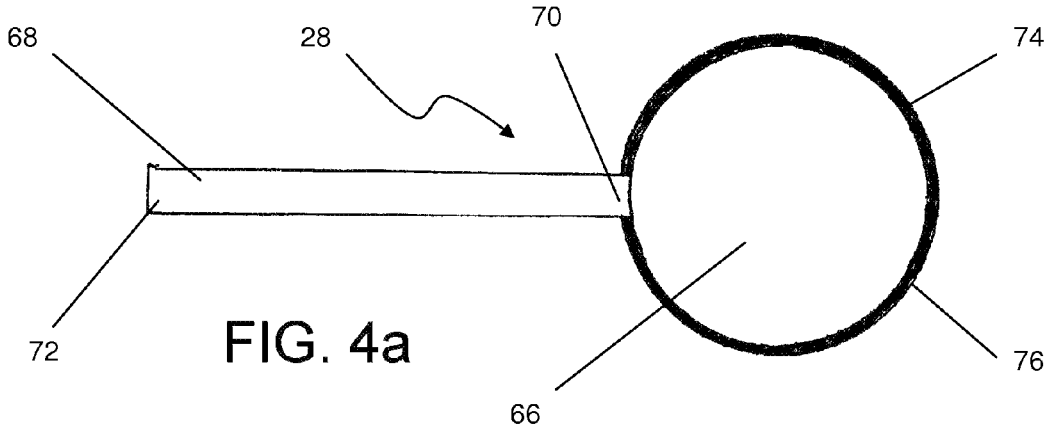
FIG. 4*a* is a top view of a paddle, FIG. 4 *b* is a front view of a paddle.
Figure 4B:
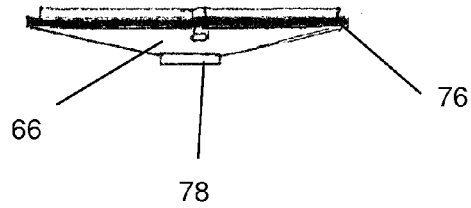
FIG. 4*c* is a side view of a paddle.
FIG. 4*d* is a bottom view of a paddle.
Figure 4C:
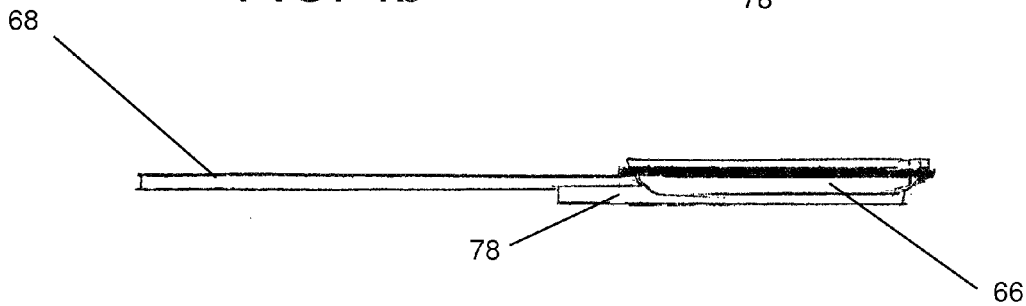
Figure 4D:
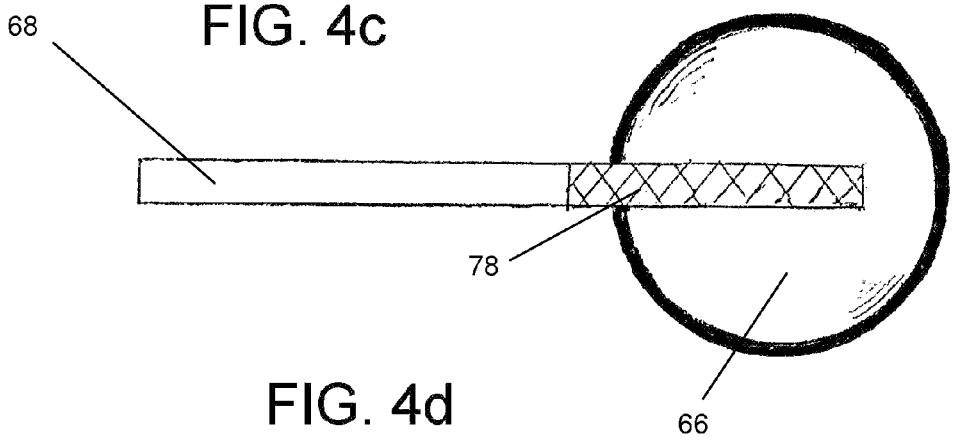
Figure 5:
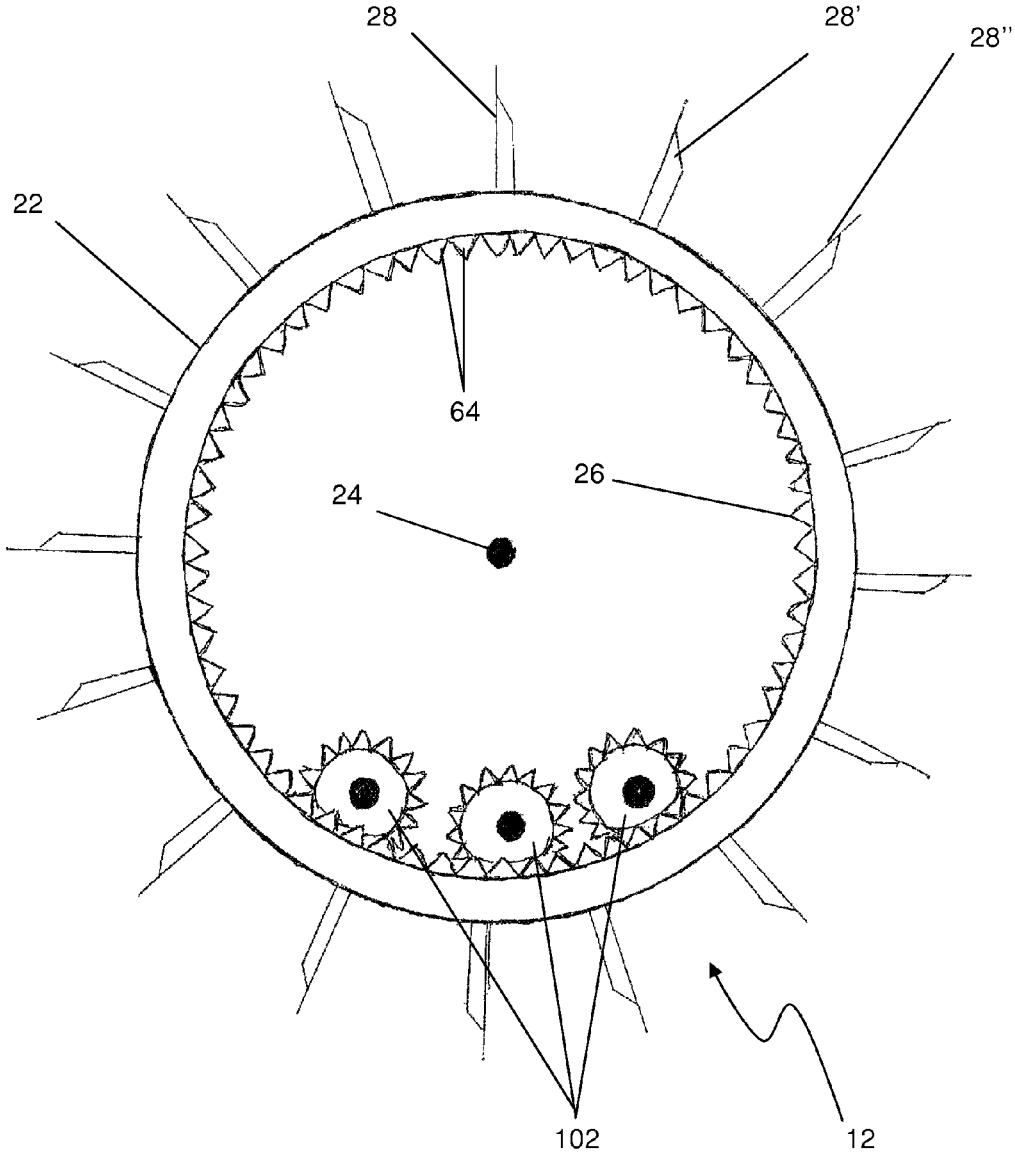
FIG. 5 is an enlarged view of the wheel assembly along with drive gears which can form part of the means for driving the mechanical pump.

As shown in FIGS. 1, 3, and 5, the wheel assembly 12 includes the wheel 22 having the axle 24 as its concentric rotatable hub. Preferably the wheel 22 and the axle 24 are secured together such that rotation of the wheel 22 drives rotation of the axle 24. Although not shown, the axle 24 is preferably secured to means for generating electricity (e.g., a generator), either directly or via a transmission or any other suitable mechanical linkage for varying the rotational speed and torque of the axle 24. As the wheel 22 is rotated according to the manner described below, the axle 24 is rotated, thereby producing electricity.

The wheel assembly 12 also includes a ring gear 26 which is positioned on the wheel 22 and located concentrically therewith. As described in further detail below, the ring gear 26 can be used to drive at least one mechanical pump 58. The ring gear 26 can have its teeth 64 facing either inwardly toward the axle 24 or outwardly toward the outer circumference 65 of the wheel 22. Preferably, the teeth 64 face inwardly toward the axle 24 as shown in FIG. 5. The ring gear 26 can further be positioned on the wheel 22 at any suitable radial distance from the axle 24. As described further below, one having ordinary skill in the art can determine any optimal radial position based upon the speed and torque to be delivered to each pump assembly 20.

The wheel 22, axle 24, and ring gear 26 can comprise any suitable type of material which is well known in the art. Preferably, the wheel 22, axle 24, and ring gear 26 comprise a metal, and even more preferably, comprise a metal having corrosion-resistant properties when in the presence of oil-based solutions, such as stainless steel, aluminum, galvanized steel, etc. The wheel 22, axle 24, and ring gear 26 can also comprise any other suitable type of material, such as a polymer, wood, a composite, and so forth.

The wheel assembly 12 additionally comprises a plurality of paddles 28,28',28", etc. extending outwardly from the wheel 22. As shown in FIGS. 4*a-d*, each paddle includes a plate 66 and a shaft 68. The shaft 68 has a first end 70 which is connected to the bottom of the plate 66, and a second end 72 which is secured to the outer circumference 65 of the wheel 22. The paddles 28,28',28", etc. are secured to the outer circumference 65 of the wheel using any suitable means, such as using fasteners, welding, or the like. The outer circumference 65 of the wheel 22 can also include a plurality of holes or receiving slots (not shown) which are dimensioned to receive the second end 72 of the shaft 68. Preferably, each paddle 28 extends in a direction radially outwardly from the axle 24 of the wheel assembly 12, although the paddles 28,28',28", etc. can be angled from side to side or front to back (orientation not shown in the drawings).

Each plate 66 is preferably concave up, and includes an outer edge 74. The plate 66 and shaft 68 are formed from any suitable material. Preferably, the plate 66 and shaft 68 are formed from a metal, and even more preferably, from a metal having corrosion-resistant properties when in the presence of oil-based solutions, such as stainless steel, aluminum, galvanized steel, etc. The plate 66 and shaft 68 can also comprise any other suitable type of material, such as a polymer, wood, a composite, and so forth. The shaft 68, plate 66, and wheel 22 are secured to each other using any suitable means which are well-known in the art, including the use of fasteners (e.g., nuts and bolts), welding, adhesives, etc.

Optionally, the outer edge 74 of each paddle 28 can include a flexible, resilient seal 76 for forming a barrier with the inner surface 42 of the housing 14. The seal 76 and inner surface 42 form a substantially water-tight barrier to ensure that the full weight of the liquid-based material 30 forces each paddle 28 downwardly. The seal 76 can comprise any suitable type of material as understood by one having ordinary skill in the art. Preferably, the seal 76 comprises an elastomer (e.g., rubber), any suitable polymer which is flexible and resilient, or the like.

Each paddle 28 can optionally include a support bar 78 to add additional strength to the shaft 68 and/or to strengthen the connection between the shaft 68 and the plate 66.

As shown in FIG. 3, the apparatus 10 further includes the housing 14, or conduit, for delivering the liquid-based material 30 from the storage tank 16 to the plurality of paddles 28,28',28", etc. The housing 14 includes an arcuate portion 32 and an inlet portion 34, both of which comprise hollow passageways 42. The arcuate portion 32 is positioned adjacent to and around an arcuate segment 36 of the outer circumferential edge of the wheel 22. The arcuate portion 32 has an open inlet 38, an open outlet 40, and a substantially tubular curved inner surface 42, or passageway, to allow the paddles 28,28',28", etc. and liquid-based material 30 to pass therethrough. As described above, the inner surface 42 is dimensioned for close fitment about the paddles 28,28',28", etc., and the inner surface 42 forms a seal or barrier with the seal 76 on each paddle 28. The arcuate portion 32 also includes a slit, or channel (not shown), extending along its length and positioned on an inner arcuate edge to allow the shaft 68 to pass through as the wheel assembly 12 rotates.

Figures 7A, 7B:
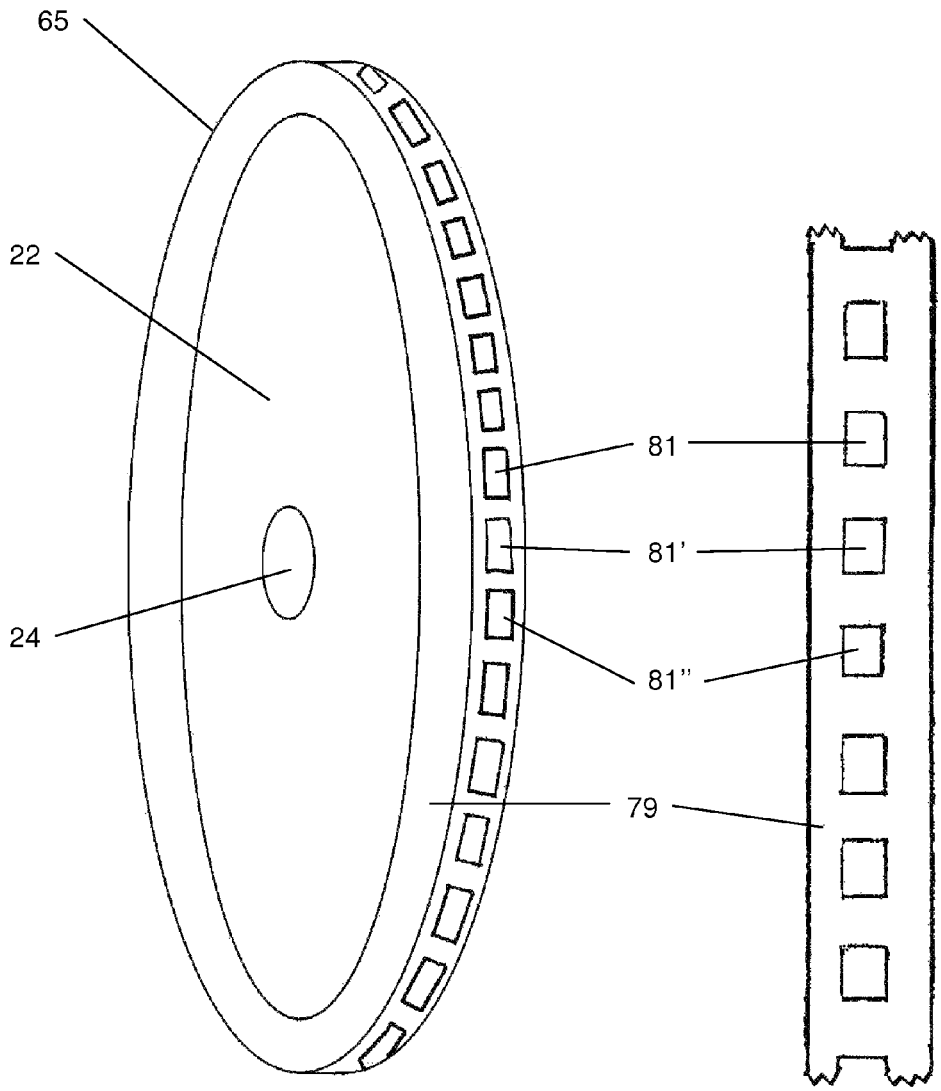
FIG. 7*a* is a perspective view of a ring gasket installed onto the wheel assembly.
FIG. 7*b* is a front partial view of the ring gasket.

As shown in FIGS. 7*a* and 7*b*, the outer circumference 65 of the wheel 22 can optionally include a ring gasket 79 for providing a seal between the outer circumference 65 and the open channel of the housing 14 as the wheel assembly 12 rotates. The ring gasket 79 comprises an elastomeric band which stretches around the outer circumference 65 for snug engagement therewith. Preferably, the ring gasket 79 is formed from a rubber material, although any suitable elastomer will work. The ring gasket 79 can be dimensioned wider than the thickness of the outer circumference 65 so that the ring gasket 79 seals around the sides and edges of the wheel 22 as well. The ring gasket 79 includes a plurality of openings 81,81',81", etc. for allowing the shaft 68 to be connected to and extend outwardly from the outer circumference 65. The openings 81,81',81", etc. can be any suitable shape to match the geometry of the shaft 68, such as a square, rectangle, circle, oval, triangle, and so forth.

Although ring gasket 79 encircles the wheel 22, the portion of the ring gasket 79 which is adjacent to the housing 14 is actually disposed within the housing 14 and not adjacent to the wheel 22. As the ring gasket 79 rotates with the wheel 22 through the housing 14, the ring gasket 79 separates from the outer circumference 65 and passes into the housing, still following the arcuate path of the wheel 22. The ring gasket 79 then exits the housing 14 and engages itself next to the outer circumference 65 once again. In this regard, the ring gasket 79 maintains a constant sealed surface with the shaft 68 of each paddle 28 as it rotates through the housing 14, thereby ensuring that none of the liquid-based material 30 is able to escape.

Preferably, the arcuate portion 32 includes a first section 80, a middle section 44, and a last section 82. The middle section 44 is dimensioned to form the water-tight seal with at least two paddles 28,28' at any given point in the rotation of the wheel assembly 12. The first and last sections 80,82 have inner diameters which vary along the length thereof to provide a transition to and from the middle section 44. For instance, the diameter of the passageway 42 at the open inlet 38 is larger than the diameter of the paddles 28,28',28", etc. The resulting gap between the passageway 42 and the paddles 28,28',28", etc. allows air to escape out of the housing 14 when the liquid-based material 30 flows onto the paddles 28,28',28", etc. The diameter of the first section 80 gradually decreases until it is the same as that of the middle section 44. Likewise, the diameter of the last section 82 at the open outlet 40 is larger than the diameter of the paddles 28,28',28", etc., and gradually decreases along its length to the point that it has the same diameter as the middle section 44. The increased diameter at the open outlet 40 allows the liquid-based material 30 to rapidly flow out of the housing 14, thereby using the kinetic energy of the flow against the bottom paddle 28 to offset any back-pressure that may occur when the upper sealing paddle 28 is receiving the initial force of the liquid-based material 30 against it when the liquid-based material 30 is moving through the housing 14.

Optionally, the arcuate portion 32 can include an air tube 84 and a check valve 86 allowing air into the arcuate portion 32 so that air can backfill behind the liquid-based material 30 exiting out the open outlet 40 of the housing 14. This allows the liquid-based material 30 to flow freely and minimizes unnecessary friction.

The inlet portion 34 of the housing 14 includes the hollow passageway 46, or conduit, having the inlet end 50 and the outlet end 52. The inlet end 50 is secured to the storage tank 16 and the outlet end 52 is secured to the arcuate portion 32 of the housing 14. The inlet portion 34 delivers the liquid-based material 30 from the storage tank 16 to the arcuate portion 32 of the housing 14.

The housing 14 is formed from any suitable material. Preferably, the housing 14 is formed from a metal, and even more preferably, from a metal having corrosion-resistant properties when in the presence of oil-based solutions, such as stainless steel, aluminum, galvanized steel, etc. The housing 14 can also comprise any other suitable type of material, such as a polymer, wood, a composite, and so forth. The arcuate portion 32 and the inlet portion 34 are secured to each other using any suitable means which are well-known in the art, including the use of fasteners (e.g., nuts and bolts), welding, adhesives, etc.

Figure 2:
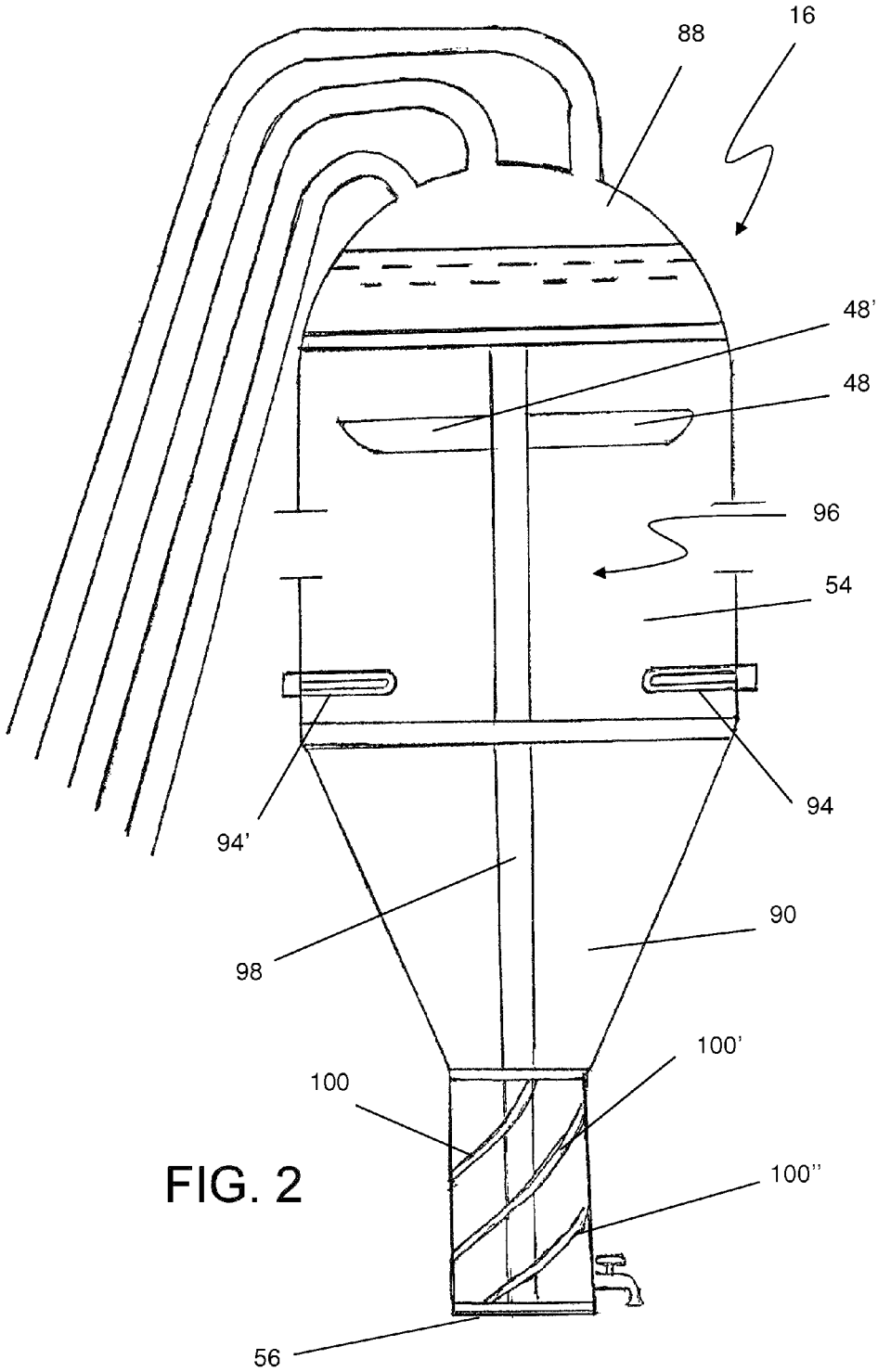
FIG. 2 is an enlarged view of the storage tank including optional components.

As shown in FIG. 2, and as mentioned above, the storage tank 16 has an interior chamber 54 for housing the liquid-based material 30, and an outlet 56 for releasing or expelling the liquid-based material 30. Preferably, the outlet 56 is located at the bottom of the interior chamber 54. Preferably, the storage tank 16 also has a closed top 88. Although the interior chamber 54 can comprise any suitable shape, preferably it is a generally cylindrical volume which is co-axial with a vertical axis. Optionally, the top 88 is dome-shaped, and the tank 16 has a lower portion 90 which funnels or narrows toward the outlet 56. Again, the storage tank 16 is preferably formed from a metal, and even more preferably, from a metal having corrosion-resistant properties when in the presence of oil-based solutions, such as stainless steel, aluminum, galvanized steel, etc. The storage tank 16 can also comprise any other suitable type of material, such as a polymer, wood, a composite, and so forth.

Optionally, the storage tank 16 can include a valve 92 positioned near the outlet 56 of the storage tank 16 to control the flow of the liquid-based material 30 exiting the storage tank 16.

Optionally, the storage tank 16 can also include at least one heating element 94 for raising the temperature of the liquid-based material 30 to reduce the viscosity of the liquid-based material 30. The temperature is preferably increased to any temperature deemed optimal by one having ordinary skill in the art, and will be dependent upon the properties of the specific liquid-based material 30 used herewith. Each heating element 94 can comprise any suitable device which is well-known in the art and practical for raising the temperature of the liquid. Preferably, each heating element 94 is similar, or the same, as the type which are used in an electric water heater. Any suitable number of heating elements 94,94', etc. can be used as determined optimal by one having ordinary skill in the art. Heating elements of this type are typically threadably secured to the tank via a threaded bung and have suitable electrical connectors on the exterior of the tank.

Optionally, the storage tank 16 can also include means 96 for mixing the liquid-based material 30 to maintain a substantially homogenous consistency. If the liquid-based material 30 is a suspension solution or one which has a tendency for particulates to settle out of the liquid, the means 96 for mixing can help maintain a homogenous consistency throughout the liquid-based material 30. In addition, the means 96 for mixing can work in conjunction with each provided heating element 94 to maintain a consistent temperature throughout the liquid-based material 30.

The means 96 for mixing can comprise any suitable structure known to one having ordinary skill in the art. For example, the means 96 for mixing can include at least one rotating shaft 98 having a plurality of paddles, or mixing bars 48,48', etc., extending outwardly therefrom which churn and mix the material as the shaft 98 rotates. The paddles 48,48', etc. can be grouped or positioned in any suitable array as deemed optimal by one having ordinary skill in the art. The rotating shaft 98 can be secured in position by a plurality of braces positioned at intervals along the length thereof.

Preferably, the means 96 for mixing can also include a plurality of vanes 100,100',100", etc. which are attached to the rotating shaft 98 and positioned proximal to the outlet 56. When the liquid-based material 30 flows through the outlet 56 of the storage tank 16, the liquid-based material 30 applies a force against the vanes 100,100',100", etc. to assist in rotating the shaft 98.

Optionally, the apparatus 10 can also include a holding tank 18 positioned below the wheel assembly 12 and the housing 14. The holding tank 18 can include a top (not shown) which is at least partially open to catch the liquid-based material 30 as it exits out of the housing 14. The holding tank 18 can comprise any suitable shape for accomplishing its objective. The holding tank 18 is preferably formed from a metal, and even more preferably, from a metal having corrosion-resistant properties when in the presence of oil-based solutions, such as stainless steel, aluminum, galvanized steel, etc. The holding tank 18 can also comprise any other suitable type of material, such as a polymer, wood, a composite, and so forth.

Figure 6:
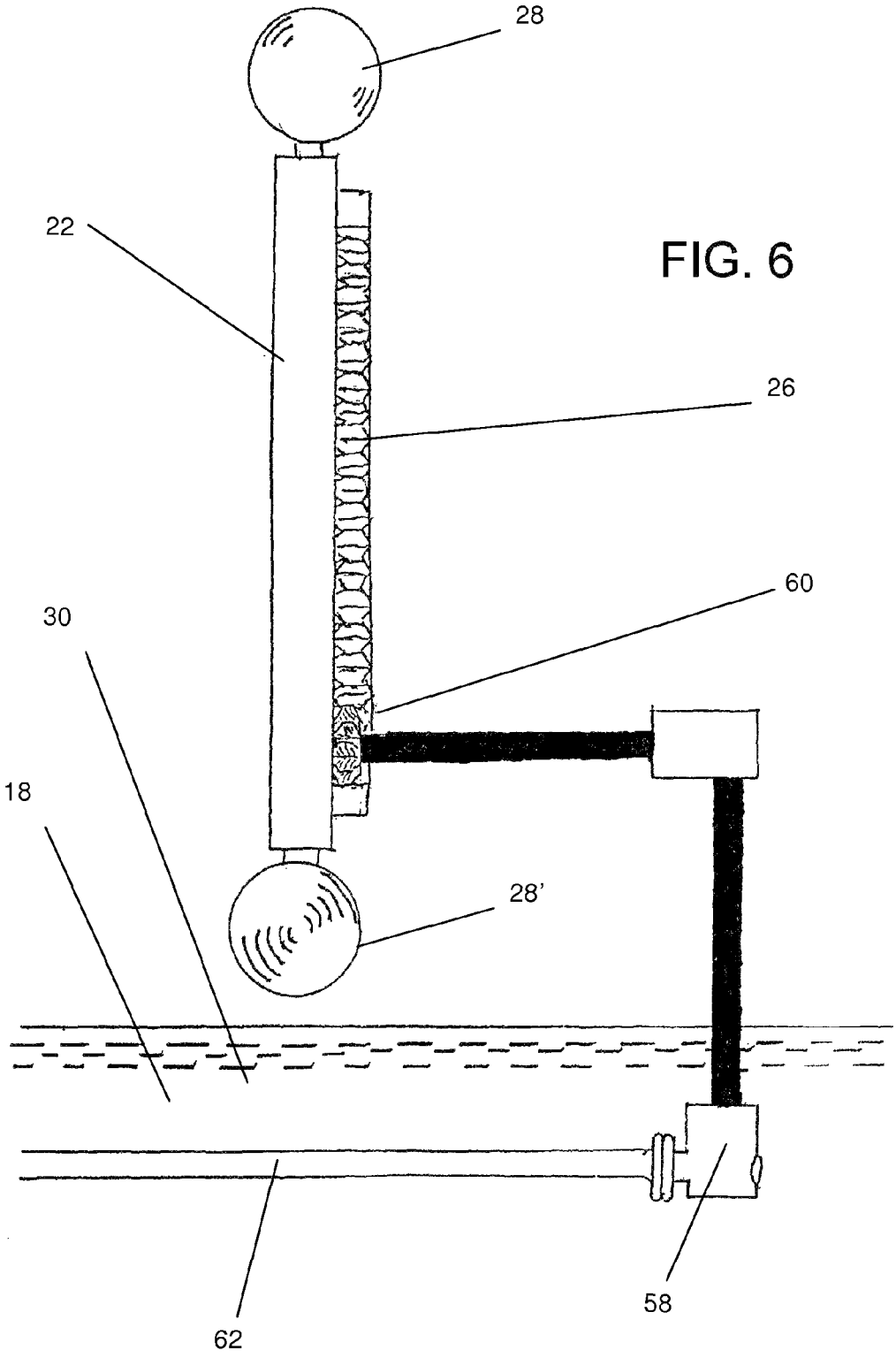
FIG. 6 is a side view of the wheel assembly, the pump assembly, and the holding tank showing an embodiment thereof.

As shown in FIGS. 1, 5, and 6, the apparatus 10 can also optionally include at least one pump assembly 20 for pumping the liquid-based material 30 out of the holding tank 18. Each provided pump assembly 20 includes a mechanical pump 58, means 60 for driving the mechanical pump, and a conduit 62 extending from the mechanical pump 58 to a position outside of the holding tank 18.

The mechanical pump 58 can comprise any suitable type of pump which is well-known to one having ordinary skill in the art. Preferably, the pump is a positive displacement or kinetic pump. Even more preferably, the pump is a rotary positive displacement pump, such as a gear pump, vane pump, screw pump, progressing cavity pump, lobe or cam pump, flexible tube (peristaltic) pump, or the like. As understood by one having ordinary skill in the art, a rotary pump is driven by rotational kinetic energy.

The mechanical pump 58 can be provided to pump the liquid-based material 30 out of the holding tank 18. The mechanical pump 58 can be positioned at any suitable location, such as actually in the holding tank 18. Alternatively, the mechanical pump 58 can be positioned outside the holding tank 18 and can be placed in fluid communication with the liquid-based material 30 in the holding tank 18 via a suitable conduit (not shown) which feeds the liquid-based material 30 from the holding tank 18 to the pump 58. An outlet conduit 62 can also be provided to deliver the liquid-based material 30 from the outlet of the pump 58 to a distal position. The distal position can be any suitable location as determined by one having ordinary skill in the art, such as a second storage tank (not shown), a filtration or cleaning system (not shown) for removing impurities from the liquid-based material 30, and so forth. Optionally, the outlet conduit 62 can deliver the liquid-based material 30 back to the storage tank 16 such that the apparatus 10 comprises a closed system in which the liquid-based material 30 is re-circulated throughout the apparatus 10.

The pump assembly 20 also includes the means 60 for driving the mechanical pump 58. Any suitable rotational or reciprocating kinetic motion can be used to drive the pump 58. Preferably the pump 58 is driven by a rotating or reciprocating shaft. Even more preferably, the means 60 for driving the mechanical pump 58 includes a drive gear 102 which is rotatably engaged with and driven by the ring gear 26 of the wheel assembly 12. The drive gear 102 provides the kinetic motion to drive the mechanical pump 58 via any suitable structure such as shafts, gears, universal joints, or any other mechanical linkage or connectors which would be understood by one having ordinary skill in the art.

It is understood that the number of pump assemblies 20,20', 20", etc. provided may be determined based upon the performance requirements for removing the specified volume of the liquid-based material 30 out of the holding tank 18. Additional pump assemblies 20,20',20", etc. may be required to remove increased volumes of the material. For instance, three pump assemblies 20,20',20" are shown in FIG. 1. Also, additional pump assemblies 20,20',20", etc. can be utilized to divide the total work load of the weight of the liquid for pumping the liquid-based material 30.

The liquid-based material 30 is preferably a thick, dense, heavy, and viscous oil-based liquid which could be described as a "sludge"; however, any suitable liquid-based material 30 as determined by one having ordinary skill in the art can be used herewith. The apparatus 10 is designed to work most efficiently with a heavy dense viscous material, generating its energy from the tremendous weight of the heavy liquid causing a tremendous amount of torque to be applied to the axle 24 from the wheel 22 and paddles 28,28',28", etc.

In use, the liquid-based material 30 exits the storage tank 16 via the outlet 56, passes through the inlet portion 34 of the housing 14 and into the arcuate portion 32. At this point, it engages with the plurality of paddles 28,28',28", etc. and forces the paddles 28,28',28", etc. through the arcuate portion 32 of the housing 14 due to its weight. The liquid-based material 30 then passes out of the housing 14 and into the holding tank 18. As the wheel assembly 12 rotates, rotational energy is provided to the axle 24 which is then transferred to the means for generating electricity (not shown). The rotating ring gear 26 also rotates each provided drive gear 102, thereby providing power to the mechanical pump 58 for pumping the liquid-based material 30 out of the holding tank 18.

As is apparent from the preceding, the present invention provides an apparatus for generating power by using the weighty flow of the heavy liquid from an elevated storage tank to rotate a wheel, which in turn, provides rotational kinetic energy which can be used to generate electricity.

What is claimed is:

1. An apparatus for generating power comprising:

(a) a wheel assembly including a wheel, an axle, a ring gear, and a plurality of paddles extending outwardly from the wheel;

(b) a liquid-based material which flows throughout the apparatus, the liquid-based material comprising a suspension solution that includes particulates;

(c) a housing for delivering the liquid-based material from a storage tank to the paddles, the housing including an arcuate portion and an inlet portion, (i) the arcuate portion being positioned around an arcuate segment of the wheel, the arcuate portion having an open inlet, an open outlet, and a substantially tubular curved inner surface having a middle section which is dimensioned for close fitment about the paddles when the wheel assembly rotates and the plurality of paddles passes through the arcuate portion;

(ii) the inlet portion of the housing including a hollow conduit having an inlet end and an outlet end, the inlet end being secured to the storage tank and the outlet end being secured to the arcuate portion, such that the inlet portion delivers the liquid-based material from the storage tank to the arcuate portion of the housing;

(d) the storage tank having an interior chamber for housing the liquid-based material, and an outlet for exiting the liquid-based material from the storage tank, the outlet being secured to the inlet portion of the housing, the storage tank including means for mixing the liquid-based material to maintain a substantially homogenous consistency throughout the liquid-based material in the storage tank;

(e) a holding tank positioned below the wheel assembly and the housing for collecting the liquid-based material which has passed through the housing and exited the outlet of the arcuate portion;

(f) at least one pump assembly which includes a mechanical pump, means for driving the mechanical pump, and a conduit extending from the mechanical pump to a position outside of the holding tank;

(g) wherein the liquid-based material which is stored in the storage tank passes into the housing, applies a force against the plurality of paddles and rotates the wheel assembly, falls out through the bottom of the housing into the holding tank, and is then pumped out of the holding tank by the pump assembly.

2. The apparatus of claim 1 wherein the conduit extends from the mechanical pump to the storage tank.

3. The apparatus of claim 1 wherein each of the paddles has an outer edge and a seal disposed thereon for forming a barrier which does not allow the liquid-based material to pass between the seal and the inner surface of the housing.

4. The apparatus of claim 3 wherein the conduit extends from the mechanical pump to the storage tank.

5. An energy converter comprising:

(a) a storage tank for housing a liquid, the storage tank including at least one rotating shaft having a plurality of outwardly extending mixing bars for churning the liquid to maintain a homogenous consistency in the liquid;

(b) a wheel assembly including an axle and a plurality of outwardly extending paddles;

(c) a housing including an inlet and an arcuate substantially tubular channel, the channel being positioned adjacent the wheel assembly, and configured to allow the paddles to pass therethrough as the wheel assembly rotates, the channel further having at least a portion which is dimensioned to form a seal with the paddles passing therethrough;

(d) wherein the liquid flows out of the storage tank, through the housing inlet, and through the tubular channel, whereby the axle of the wheel assembly is rotated by the flow of the liquid.

6. The energy converter of claim 5 comprising a holding tank positioned below the wheel assembly and the housing for collecting the liquid which has passed through the channel.

7. The energy converter of claim 6 comprising at least one pump assembly which includes a mechanical pump, means for driving the mechanical pump, and a conduit extending from the mechanical pump to a position outside of the holding tank.

8. The energy converter of claim 7 wherein the conduit extends from the mechanical pump to the storage tank.

9. The energy converter of claim 5 comprising at least one pump assembly which includes a mechanical pump, means for driving the mechanical pump, and a conduit extending from the mechanical pump.

10. An energy converter comprising:

(a) a storage tank for housing a liquid, the storage tank including at least one rotating shaft having a plurality of outwardly extending mixing bars for churning the liquid to maintain a homogenous consistency in the liquid;

(b) a wheel assembly including an axle, a ring gear, and a plurality of outwardly extending paddles;

(c) a conduit for delivering the liquid from the storage tank to at least one paddle in which the liquid applies a substantially downward force on the paddle causing the wheel assembly to rotate; and (d) at least one pump assembly which includes a mechanical pump and a drive gear for driving the mechanical pump.

11. The energy converter of claim 10 wherein the conduit forms a sealed barrier with at least two of the rotating paddles.

12. The energy converter of claim 10 comprising a holding tank positioned below the wheel assembly and the conduit for collecting the liquid which has passed through the conduit.

13. The energy converter of claim 12 wherein the pump assembly is configured to pump the liquid out of the holding tank.

14. The energy converter of claim 12 wherein the conduit forms a sealed barrier with at least two of the rotating paddles.

* * * * *